United States Patent [19]

Nagasawa et al.

[11] Patent Number: 4,616,942

[45] Date of Patent: Oct. 14, 1986

[54] RIBBON CASSETTE WITH RE-INKING MECHANISM

[75] Inventors: Hideo Nagasawa, Oisomachi; Masao Suzuki, Yokohama; Tsutomu Hamano, Odawara, all of Japan

[73] Assignee: NCR Corporation, Dayton, Ohio

[21] Appl. No.: 584,378

[22] Filed: Feb. 28, 1984

[30] Foreign Application Priority Data

Aug. 22, 1983 [JP] Japan ..... 58-151738

[51] Int. Cl.[4] ..... B41J 32/02

[52] U.S. Cl. ..... 400/196.1; 400/195; 400/202.4

[58] Field of Search ..... 400/194, 195, 196, 196.1, 400/197, 200, 201, 202, 202.1, 202.2, 202.3, 202.4, 207, 208, 208.1, 470, 471, 471.1; 101/331, 333, 334, 335

[56] References Cited

U.S. PATENT DOCUMENTS

| | | | |
|---|---|---|---|
| 849,143 | 4/1907 | Langen | 400/201 X |
| 1,804,976 | 5/1931 | Fortier | 400/202.4 X |
| 2,005,503 | 6/1935 | Pelton | 400/201 |
| 2,104,396 | 1/1938 | Hoppenstand | 400/200 |
| 3,400,801 | 9/1968 | Swenson | 400/202.2 |
| 3,797,390 | 3/1974 | Marozzi et al. | 101/333 |
| 3,804,016 | 4/1974 | Marozzi et al. | 101/333 |
| 3,819,026 | 6/1974 | Ploeger, Jr. et al. | 400/202.1 |
| 3,987,137 | 10/1976 | Neumann et al. | 400/197 X |
| 3,989,132 | 11/1976 | Carson, Jr. | 400/196.1 X |
| 4,071,133 | 1/1978 | Scherrer et al. | 400/196 |
| 4,091,914 | 5/1978 | Stipanuk | 400/196.1 |
| 4,153,378 | 5/1979 | Scherrer et al. | 400/196.1 |
| 4,322,172 | 3/1982 | Furrow | 400/202.4 |
| 4,340,313 | 7/1982 | Bishop | 400/202.1 |
| 4,391,536 | 7/1983 | Muller et al. | 400/202 X |
| 4,449,838 | 5/1984 | Okamura et al. | 400/196.1 X |
| 4,465,388 | 8/1984 | Iwasawa | 400/202.1 X |
| 4,469,457 | 9/1984 | Chida et al. | 400/208 |
| 4,493,572 | 1/1985 | Van Ocker et al. | 400/196.1 |
| 4,526,487 | 7/1985 | Ikeda | 400/196.1 X |

FOREIGN PATENT DOCUMENTS

| | | | |
|---|---|---|---|
| 2550305 | 5/1977 | Fed. Rep. of Germany | 400/196.1 |
| 0005782 | 1/1981 | Japan | 400/196 |
| 0110284 | 6/1983 | Japan | 400/202 |
| 85/01017 | 3/1985 | PCT Int'l Appl. | 400/196.1 |

*Primary Examiner*—Ernest T. Wright, Jr.

*Attorney, Agent, or Firm*—Wilbert Hawk, Jr.; George J. Muckenthaler

[57] ABSTRACT

A ribbon cassette with re-inking mechanism includes a removable ink supply tank having a low density ink element and a high density ink element, and an ink transfer roller engaging the high density ink element and having an uneven surface on the periphery thereof for carrying ink in controlled manner from the high density ink element to the ribbon.

12 Claims, 4 Drawing Figures

RIBBON CASSETTE WITH RE-INKING MECHANISM

BACKGROUND OF THE INVENTION

In the field of ink ribbons for printers, a ribbon supply spool and a ribbon take-up spool generally have been provided on opposite sides of a typing or printing station, together with means for reversing the direction of travel of the ribbon for repeated use thereof in an arrangement for the purpose of obtaining longer ribbon life. Also, the ink ribbon has been made to travel along a line of printing wherein the spools are positioned beyond the ends of the printing line and the ribbon is caused to travel at an angle relative to the print line to utilize a greater portion of the ribbon width. However, in the case of certain high-speed printers, a ribbon substantially as wide as the line of printing may be used and caused to travel in a direction normal to the print line and along with the record media. Additionally, it has been common to provide ink carrying or containing means operably associated with the ribbon for maintaining or replenishing a supply of ink therein for proper and extended-life printing operation.

In present-day printers, it is also common practice to provide and use a ribbon cassette carrying an endless ribbon which is caused to be driven past the printing station, and wherein the printing ribbon is either a pre-inked and disposable ribbon or a ribbon which is to be continuously or frequently reinked during the printing operation. The ribbon cassette itself may be of the stuffing-box type wherein the ribbon is contained within the cassette in random manner and such ribbon is unfolded at the cassette exit and caused to be driven past the printing station and then guided back into the cassette to be folded again in random manner therein.

Additionally, a ribbon may be utilized in a mobius loop configuration within the cassette, may be in substantially continuous contact with an inking core or like member, or the ribbon may have a plurality of coils thereof around a central core for controlled inking or re-inking of the ribbon.

Representative documentation relating to ribbon cassettes or cartridges and to inking or re-inking the ribbon therein includes U.S. Pat. No. 2,005,503, issued to G. E. Pelton on June 18, 1935, which discloses means for supplying ink to ink transfer members by means of a tubular wick extending from a reservoir and engaged with an ink-transfer disk coaxial with a ribbon-contacting roller.

U.S. Pat. No. 2,104,396, issued to D. Hoppenstand on Jan. 4, 1938, discloses an inking device having a cylinder of ink with a sleeve and a felt strip between the sleeve and the cylinder and engageable with an adjacent roller through an opening in the wall of the cylinder.

U.S. Pat. No. 3,400,801, issued to O. W. Swenson on Sept. 10, 1968, discloses a reusable inking cartridge having a wick reservoir with an opening for a flat wick, and a second or transfer wick on the cover of the reservoir and in contact with the flat wick and with the ribbon.

U.S. Pat. No. 3,797,390, issued to A. A. Marozzi et al. on Mar. 19, 1974, discloses an ink cartridge with sealing means wherein an ink container has a foam filler, exposed to a marking device at an open end of the cartridge through a porous pad, and a restricted opening in a porous closure disk.

U.S. Pat. No. 3,804,016, issued to A. A. Marozzi et al. on Apr. 16, 1974, discloses a yieldably mounted, sealable ink cartridge having an ink container with an ink pad exposed to a marking device through a restricted opening in a closure element, and pumping action adjusts pressure thereon to maintain ink pad saturation.

U.S. Pat. No. 3,987,137, issued to E. W. Neumann et al. on Oct. 19, 1976, discloses a method of making a direct inking platen including a container having a fiber-filled ink medium and a microporous interior enclosure between the ink medium and the ribbon.

U.S. Pat. No. 4,071,133, issued to H. Scherrer et al. on Jan. 31, 1978, discloses a ribbon cassette for dye-impregnated ribbon and containing an ink cylinder or canister therein having a wick disposed in contact with a transfer roller for re-inking the ribbon.

U.S. Pat. No. 4,153,378, issued to H. Scherrer et al. on May 8, 1979, discloses a housing having a chamber with an ink-impregnating wick in the chamber along with locking means for moving the wick into contact with an inking roller.

U.S. Pat. No. 4,340,313, issued to J. W. H. Bishop on July 20, 1982, discloses printing ribbon spool apparatus and method of inking the type slug impact portion of ribbons and having a pad of cellular or fibrous material which carries ink from a reservoir to the ribbon through an exposed area of the pad.

And, U.S. Pat. No. 4,391,536, issued to M. Muller et al. on July 5, 1983, discloses a print wheel assembly which has a pigment carrier of capillary-fabric material which draws ink from a reservoir to supply sufficient ink to feed the transfer layer for the useful life of the wheel.

SUMMARY OF THE INVENTION

The present invention relates generally to ribbon cassettes for use in impact printers. More particularly, the present invention relates to means for inking or re-inking the ribbon in the cassette for the purpose of extending the life of the ribbon and to maintain the ribbon in a properly-inked condition at all times.

The ribbon cassette or cartridge of the present invention may be used in business machines which incorporate an impact printer therein and which printer may be required to operate at high efficiency for extended periods of time. The cassette includes a ribbon drive means adjacent a stuffing-box type chamber along with various means for directing the ribbon in a path from the chamber, through a mobius loop section, past a front portion which is proximal the printing station of the machine, and then back to the drive means.

A separate chamber of the cassette contains re-inking mechanism in the form of a removable tank or reservoir which holds an ink-impregnated element of low compression or lesser density, porous material. A second ink-impregnated element of high compression or greater density, porous material is positioned in contact with the first-mentioned element and is placed in an opening in a wall of the tank or reservoir, and which wall is formed to provide space for an inking element in the nature of a grooved or irregular-surfaced roller. The inking element is adjacent and driven by the ribbon drive means, and the ribbon is caused to be directed between and in contact with both the drive means and the inking element to be continuously re-inked during operation of the printer.

In view of the above discussion, the principal object of the present invention is to provide re-inking mechanism in a ribbon cassette for extending the useful life of the ribbon.

Another object of the present invention is to provide a ribbon cassette having re-inking mechanism which is removable for replacement thereof.

An additional object of the present invention is to provide a primary element and a secondary element for continuously re-inking a ribbon in a cassette.

A further object of the present invention is to provide re-inking mechanism in a ribbon cassette wherein the mechanism includes an ink transfer roller having an uneven surface thereon for ensuring controlled distribution of ink to the ribbon.

Additional objects and advantages of the present invention will become apparent and fully understood from a reading of the following specification taken together with the annexed drawing.

DESCRIPTION OF THE PREFERRED EMBODIMENT

Figure 1:
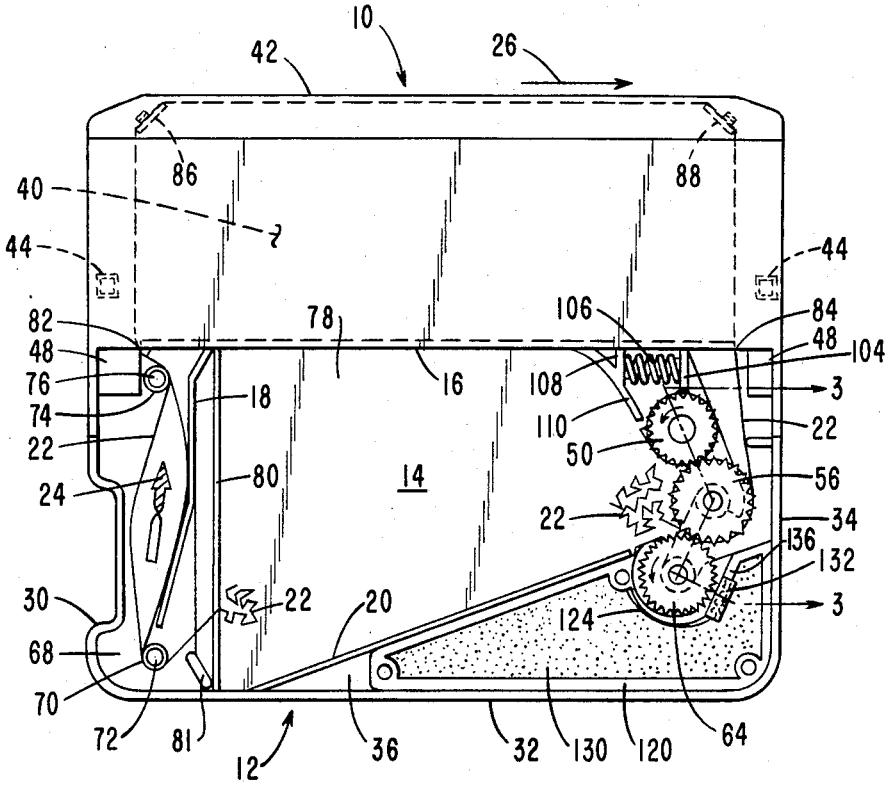
FIG. 1 is a top plan view of a ribbon cassette incorporating the subject matter of the present invention.

In FIG. 1 is illustrated a ribbon cassette, generally designated as 10, and having the cover removed therefrom to show the interior structure and the various components thereof in a preferred arrangement of the subject matter of the present invention. The cassette 10 includes a body 12, preferably of molded plastic material and in the shape of a generally rectangular flat case (see also FIG. 2), for supporting the ribbon 22 thereof and which cassette 10 is adapted to fit adjacent or along the printing station of a printer (not shown). The cassette body 12 includes a large cavity or chamber 14 formed in part by a front wall 16 extending nearly the width of the cassette 10, a leftward wall 18 of irregular shape and extending generally perpendicular rearward from the wall 16, and a rearward wall 20 angling toward the right side of the cassette body 12. While the orientation of the cassette 10 itself is not critical to operation of the parts therein, the terms used herein may apply to the orientation of the cassette 10 when installed on a printer and wherein the wall 32, as illustrated in FIG. 1, is nearest the operator when the cassette 10 is placed in a horizontal attitude. In certain printers the cassette 10 may be used in a vertical attitude wherein the wall 32 thereof is in a downward direction.

A ribbon 22 of the endless type is provided in the cavity 14 and is caused to be trained and driven therefrom in a path as shown by the arrow 24 at the left side of the cavity 14, and as shown by the arrow 26 at the front of the cassette 10. The body 12 of the cassette 10 is completed beyond the defined walls 16, 18, 20 of the cavity 14 by an irregular-formed left side wall 30 and continuing along the rear wall 32 and then along a right side wall 34. A second cavity 36 is formed in the rearward portion of the body 12 by the angled wall 20, the rear wall 32 and a portion of the right side wall 34.

The front part of the cassette 10 is formed of a hollow portion 40 extending across the width of the body 12 and occupying the space from the wall 16 to the front edge 42. The hollow, generally rectangular portion 40 is formed to provide a housing or protective cover for a print head or a plurality of individual print solenoids which are connected as a part of the printer. When the cassette 10 is placed or mounted on the printer and the printer is operated, the print head or solenoids are caused to be driven in a side-to-side direction under the protective cover of the cassette 10. A pair of openings 44 are provided and formed in the underside of the housing or cover at the sides thereof for positioning the cassette 10 on the printer. A cover 46, shown in FIG. 2, encloses the cavity 14 and rearward portion of the body 12 of the cassette 10 formed by the walls 16, 30, 32 and 34. A pair of projections 47 at the front of the cover 46 and integral therewith fit into openings 48 in the body 12 for securing the cover 46 thereon.

Figure 2:
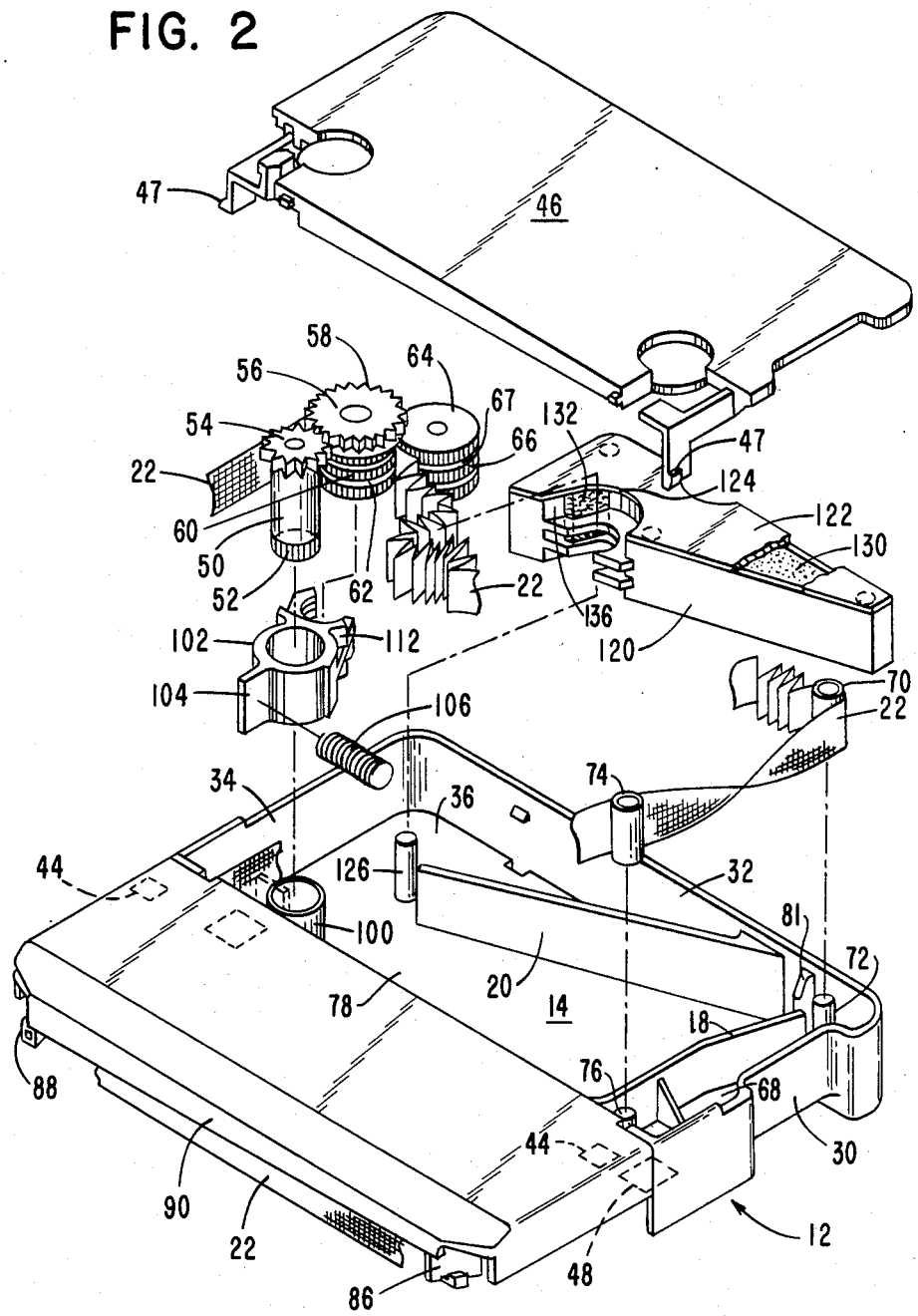
FIG. 2 is a perspective view showing the parts of the ribbon cassette in exploded manner.

The internal components of the body 12 of the cassette 10 include a driving member or roller 50 having a lower splined portion 52, as best seen in FIG. 2, for connection to a mating drive member (not shown) on the printer, and an upper tooth-like gear portion 54. Another internal component of the body 12 is a driven member or roller 56 having an upper toothlike gear portion 58 for mating with the gear portion 54 of member 50, and also having a lower grooved or tooth-like portion 60 defining one or more circumferential grooves 62. The driven member 56 is associated with and drives a ribbon inking member in the form of a roller 64 having a grooved or tooth-like portion 66 mating with the grooved portion 60 of the driven member 56, as further illustrated in FIG. 3, the grooves portion 66 also defining one or more circumferential grooves 67. The ribbon inking member 64 occupies a portion of the second cavity 36 (FIG. 1) of the body 12. At the left side of the large cavity 14 and being a portion of the body 12 of the cassette 10 is a third cavity 68 (FIG. 1) formed by the wall 18, a small leftward portion of the wall 16, the wall 30 and a small portion of the wall 32 to provide a compartment for twisting the ribbon 22 in mobius-loop manner between a roller 70 journaled on a pin or shaft 72 at the rearward side of the cavity 68 and a roller 74 journaled on a pin or shaft 76 at the cavity forward side. The wall 18 approaches the roller 70 but is short of the rearward wall 32 to provide a passageway for the ribbon 22 from the cavity 14 to the cavity 68.

The ribbon 22 is caused to be moved or driven in the direction of the arrows 24 and 26 by means of the roller 50 driving the roller 56 with the ribbon 22 being in contact with the toothed or wedged-groove like portion 60 thereof and between and in contact with such toothed portion 60 and the toothed or similar wedged-groove like portion 66 of the inking roller 64 (FIGS. 2, 3 and 4), and then into the cavity or chamber 14 (FIG. 1). It is, of course, to be noted that while the ribbon 22 is shown as a single strand within the cavity 14, the ribbon 22 is folded many times in random manner to substantially fill or stuff the cavity 14, and further that the cavity 14 includes a floor 78 to support and contain the ribbon 22.

The ribbon 22 crosses a slightly raised dam portion 80 (FIG. 1) at the left side of the cavity 14, goes through the passageway formed by the end of the wall 18 and a projection 81 on the inside of the wall 32, turns the corner at roller 70, twists 180 degrees between the roller 70 and the roller 74, and then exits from cavity 68 at 82 and moves toward the front edge 42 of the cassette 10. The ribbon 22 moves along the front edge 42 in the direction of the arrow 26 and then goes through an entrance at 84 and toward the periphery of the driven roll 56. The front of the cassette 10 includes guide means 86 and 88, as seen in FIG. 2, along with a ribbon guard or shield 90 which is preferably a thin plastic strip secured to the front edge 42. The guide means 86 and 88 are formed to both support and guide the ribbon 22 as it turns the corners at the front of the cassette 10. The ribbon 22, at least in part, is directed along a path behind the guard 90 and may be in contact therewith as it travels past the printing station. The ribbon guard or shield 90 permits the feeding of the ribbon 22 past the printing station without staining the paper.

Figure 3:
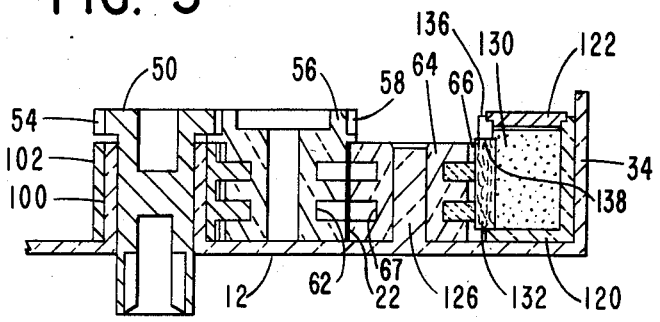
FIG. 3 is a sectional view, taken along the line 3—3 of FIG. 1.

As illustrated in FIGS. 2 and 3, the drive roller 50 is journaled in a cylindrical member or sleeve 100 which may be an integral part of the cassette body 12, and associated therewith is a support arm 102 which is journaled on the member 100. The support arm 102 has a projection 104 (FIG. 2) extending toward the front of the cassette 10 and a coil spring 106 extends between a side surface of the projection 104 and a portion 108 of a short wall 110 (FIG. 1) adjacent the forward wall 16. The spring 106 urges the roller 56 into engagement with the roller 64 by means of a guide portion 112 (FIG. 2) of such support arm 102 being formed to fit partially around and contain the driven roller 56. As illustrated, the guide portion 112 has a two stage, tongue-and-groove-like construction for bearing and guiding the driven roller 56 (FIG. 3) and, under urgency of the spring 106, rotatably holds the driven roller 56 in position with respect to the inking roller 64 and controls the winding of the ribbon 22 therearound.

The re-inking mechanism of the present invention includes a removable reservoir or tank 120 of generally triangular shape (FIGS. 1 and 2) to fit into the cavity space 36 defined by the angled wall 20, the rearward wall 32 and a rearward portion of the right side wall 34. The reservoir 120 has a cover 122 suitably secured thereto. Further, the reservoir 120 is formed with a cut-out portion 124 in one side to accommodate and fit partially around the inking roller 64 which is journaled on a shaft 126 and which shaft may be an integral part of the cassette body 12, as seen in FIG. 3. The cut-out portion 124 also has a two-stage, tongue-and-groove-like construction for bearing and guiding the inking roller 64, in addition to providing the portions for stripping the ribbon 22 from the inking roller 64.

The reservoir 120 contains an ink-filled or impregnated porous element 130 (FIG. 3) of low compression or lesser density material and an ink-filled porous element 132 of high compression or greater density material, the latter element being a generally rectangular portion positioned and contained in a window 138 in a wall 136 of the reservoir adjacent the cut-out portion 124 (see also FIG. 2). It is recognized that the low density-material element 130 is a primary source of ink for the ribbon 22 by and through transfer thereof to the high density-material element 132 which provides a continuous and controlled supply of ink to the inking roller 64. A suitable low density material for element 130 is polyurethane foam, sold under the name of Everlight Scott PH-25 or PH-40 by Bridgestone Tire Co., Ltd., and a suitable high density material for element 132 is polyurethane foam, sold under the name of Everlight Scott PH-10 by the same company.

Figure 4:
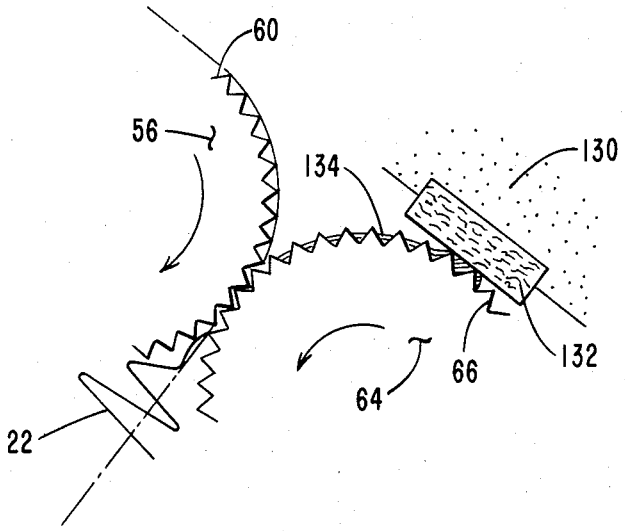
FIG. 4 is a diagrammatic view illustrating the re-inking operation.

FIG. 4 illustrates the arrangement and operation of the parts in simplified manner wherein the driven roller 56 causes rotation of the inking roller 64 through spring 106 urged engagement of the grooved portion 60 of roller 56 and the grooved portion 66 of roller 64 with the ribbon 22 therebetween. The element 130 contains a major supply of ink and the element 132 contains a lesser amount of ink with the latter element 132 being in pressure contact with the grooved portion 66 of the inking roller 64, and wherein the ink 134 is contained by surface tension in the grooves of portion 66 and is carried in evenly distributed amount or quantity, as seen on the periphery of the inking roller 64 and represented by the decreasing height ink flow on such tooth-like surface 66, from the element 132 to the ribbon 22.

The mechanism of the present invention provides for reinking the ribbon 22 from the local inking element 132 through pressure contact of the inking roller 64 therewith and driving contact of such inking roller 64 with the ribbon 22 prior to moving thereof into the large chamber 14. The effect of the driven roller 56 and ink transfer roller 64 arrangement is to pull the ribbon 22 from the chamber 14, through the mobius loop section, past the printing station and back into the body 12 of the cassette 10. The ink 134 is essentially held or contained in the wedge-like grooves in the inking roller 64 and is controlled in a manner so that ink 134 is not supplied to the ribbon 22 in undesirable amounts and/or at undesirable times. Further, the mechanism of the present invention is constructed to avoid unintentional reversal of the direction of rotation of the driven roller 56 by reason of the spring 106 urging the support arm 102 and thereby bias such driven roller 56 against the ink transfer roller 64. The arrangement increases the efficiency of the amount of ink 134 being used in the printing operation compared to the supply of ink 134, and also ensures a steady flow of ink 134 to the ribbon 22.

It is thus seen that herein shown and described is a re-inking mechanism in a ribbon cassette 10 which utilizes a low density element 138 and a high density element 132 to provide a desired amount and controlled supply of ink 134, through use of an uneven surfaced inking roller 64, to the ribbon 22 during operation of the printer. The mechanism of the present invention enables the accomplishment of the objects and advantages mentioned above, and while a preferred embodiment has been disclosed herein, variations thereof may occur to those skilled in the art. It is contemplated that all such variations not departing from the spirit and scope of the invention hereof are to be construed in accordance with the following claims.

We claim:

1. Re-inking means for a ribbon in a cassette comprising:

ink supply including a first ink carrying porous element of one density and a second ink carrying porous element of a greater density in contact with the first ink carrying porous element for transferring ink therefrom to the second ink carrying porous element, roller means comprising a drive roller and a driven roller engageable for driving said ribbon for use in printing operations, and an ink transfer roller engageable by said ribbon and in contact with the second ink carrying porous element of the ink supply means and driven by said driven roller of the ribbon driving roller means, said ink transfer roller having a plurality of uneven portions on the periphery thereof for carrying ink from the second ink carrying porous element of the ink supply means to the ribbon upon rotation of the driven roller of the ribbon driving roller means and of the ink transfer roller with the ribbon therebetween.

2. The re-inking means of claim 1 wherein the ink transfer roller and the driven roller of the ribbon driving roller means each includes at least one circumferential groove for bearing thereof.

3. The re-inking means of claim 2 including bearing means supporting said driven roller of the ribbon driving roller means and spring means biasing the drive roller into engagement with said driven roller and biasing the driven roller into engagement with the ink transfer roller.

4. The re-inking means of claim 1 wherein said ink supply means includes a reservoir removable from the cassette and containing the first element of porous material therein and having a wall defining a window therein for containing the second element of porous material, said second element engaging the first element and transferring ink therefrom to the ink transfer roller, the reservoir including means integral with said wall for bearing the ink transfer rollers.

5. A ribbon cassette containing a ribbon and comprising roller means comprising a drive roller and a driven roller engageable for driving said ribbon into and out of said cassette for use in printing operations, ink supply means with said cassette including a first ink carrying element of porous material of one density and a second ink carrying element of porous material of a greater density engaging with the first ink carrying element for transferring ink therefrom to the second ink carrying element, and a roller for transferring ink from the second ink carrying element of said ink supply means to said ribbon in a controlled manner whereby said ink transferring roller includes a plurality of uneven surfaces on the periphery thereof for carrying ink from the second ink carrying element of the ink supply means to the ribbon upon rotation of the driven roller of the ribbon driving roller means and of the ink transferring roller with the ribbon therebetween.

6. The ribbon cassette of claim 5 wherein said ink supply means is a reservoir containing the first porous element and the second porous element adjacent said ink transferring roller and the reservoir is removable from the cassette.

7. The ribbon cassette of claim 5 wherein the driven roller of the ribbon driving roller means and the ink transferring roller each includes at least one circumferential groove for bearing thereof.

8. The ribbon cassette of claim 7 including bearing means supporting said driven roller of the ribbon driving roller means and spring means biasing the drive roller into engagement with said driven roller and biasing the driven roller into engagement with the ink transferring roller.

9. The ribbon cassette of claim 5 wherein said ink supply means is a reservoir removable from the cassette and having integral bearing means for supporting and guiding said ink transferring roller and containing the first porous element of one density and having a wall portion defining a window therein for containing the second porous element of greater density and engaging of said second porous element with the ink transferring roller.

10. In a ribbon cassette containing a ribbon and having means for storing the ribbon and means including a drive roller and a driven roller engageable for driving the ribbon into and out of the cassette for use in printing operations, an improved ribbon re-.inking mechanism comprising:

ink supply means within the cassette including a first ink carrying porous element of one density and a second ink carrying porous element of a greater density in contact with the first ink carrying porous element for transferring ink therefrom to the second ink carrying porous element; and an ink transfer roller engageable by the ribbon and in contact with the second ink carrying porous element of the ink supply means and driven by said driven roller of the ribbon driving means, said ink transfer roller having a plurality of projections on the periphery thereof for carrying the second ink carrying porous element of the ink supply means to the ribbon upon rotation of the driven roller of the ribbon driving means and of the ink transfer roller with ribbon therebetween.

11. In the ribbon cassette of claim 10 wherein said ink supply means comprises a reservoir containing the first porous element of one density and includes a wall portion defining a window therein containing the second porous element of greater density and wherein the reservoir is removable from said cassette.

12. In the ribbon cassette of claim 11 wherein the driven roller of said ribbon driving means and said ink transfer roller each includes at least one circumferential groove and said cassette includes a roller supporting member having at least one portion extending into a respective groove for bearing the driven roller of the ribbon driving means and the wall portion of the reservoir includes means integral therewith for bearing the ink transfer roller.

* * * * *

UNITED STATES PATENT AND TRADEMARK OFFICE

CERTIFICATE OF CORRECTION

PATENT NO. : 4,616,942

DATED : October 14, 1986

INVENTOR(S) : Hideo Nagasawa et al.

It is certified that error appears in the above—identified patent and that said Letters Patent is hereby corrected as shown below:

Column 6, line 52, after "ink supply", insert --means--.

Column 7, line 28, delete "with" and substitute --within--.

Column 8, line 33, after "carrying", insert --ink from--.

Column 8, line 37, after "with", insert --the--.

Signed and Sealed this

Sixth Day of January, 1987

*Attest:*

DONALD J. QUIGG

*Attesting Officer*

*Commissioner of Patents and Trademarks*